US009573251B2

(12) United States Patent
Chen

(10) Patent No.: US 9,573,251 B2
(45) Date of Patent: Feb. 21, 2017

(54) GEAR GRASPING DEVICE

(71) Applicant: Jun-Fan Chen, Taichung (TW)

(72) Inventor: Jun-Fan Chen, Taichung (TW)

( * ) Notice: Subject to any disclaimer, the term of this patent is extended or adjusted under 35 U.S.C. 154(b) by 142 days.

(21) Appl. No.: 14/579,635

(22) Filed: Dec. 22, 2014

(65) Prior Publication Data

US 2015/0107424 A1 Apr. 23, 2015

Related U.S. Application Data

(63) Continuation-in-part of application No. 13/537,020, filed on Jun. 28, 2012, now abandoned.

(51) Int. Cl.

| | |
|---|---|
| ***B25B 9/04*** | (2006.01) |
| ***B25B 13/50*** | (2006.01) |
| ***B25B 5/14*** | (2006.01) |
| ***B25B 5/10*** | (2006.01) |

(52) U.S. Cl.
CPC *B25B 5/14* (2013.01); *B25B 5/102* (2013.01)

(58) Field of Classification Search
CPC ..... B25B 5/102; B25B 5/101; B25B 5/14; B25B 5/147; B25B 13/5058; B25B 7/04
USPC ..... 81/176.3
See application file for complete search history.

(56) References Cited

U.S. PATENT DOCUMENTS

| | | | | |
|---|---|---|---|---|
| 271,250 | A | 1/1883 | Kinney | |
| 875,702 | A | 1/1908 | Ely | |
| 1,044,290 | A * | 11/1912 | Taylor | B61H 13/02 254/100 |
| 1,180,904 | A * | 4/1916 | Brunner | B25B 13/505 81/126 |
| 1,579,992 | A | 4/1926 | Altman | |
| 1,808,821 | A | 6/1931 | Rubalcaba | |
| 2,121,085 | A | 6/1938 | Krumholz | |
| 3,274,675 | A * | 9/1966 | Jackson | B25B 27/06 29/267 |
| 3,857,307 | A | 12/1974 | Hegel | |
| 6,345,558 | B1 | 2/2002 | Wilson | |
| 6,978,703 | B2 | 12/2005 | Whitehead et al. | |
| 7,077,036 | B1 | 7/2006 | Adams | |
| 2010/0083798 | A1 | 4/2010 | Tai | |

* cited by examiner

*Primary Examiner* — Hadi Shakeri
(74) *Attorney, Agent, or Firm* — Muncy, Geissler, Olds & Lowe, P.C.

(57) ABSTRACT

A gear grasping device includes a main body, a first jaw, a second jaw, and an adjustment means. The main body is provided with a curved portion accompanied with an opening. The first jaw and the second jaw are disposed on the main body. The opening is arranged between the first jaw and the second jaw. By the adjustment means, position of the first jaw is changeable for adjusting a jaw span between the first jaw and the second jaw. Therefore, the gear grasping device is fit for sizes of gears, and is operation-friendly.

15 Claims, 5 Drawing Sheets

GEAR GRASPING DEVICE

FIELD OF THE INVENTION

The present invention is a CIP of application Ser. No. 13/537,020, filed Jun. 28, 2012, the entire contents of which are hereby incorporated by reference.

BACKGROUND OF THE INVENTION

Description of the Prior Art

Camshaft plays an important rule in engines of automobiles. Structures of camshaft and the components disposed around are complicated and tangled. In general, disassembling camshaft for maintenance and reparation should be proceeded after disassembly of timing gear. For disassembling timing gear, the timing gear has to be held stably, or the timing gear would rotate randomly during dismounting the nut.

Conventional timing gear pliers are then provided for clipping timing gear, as described in U.S. Pat. No. 6,345,558 and U.S. Pat. No. 7,077,036. However, user can seldom manipulate these pliers comfortable. User has to grab these pliers harder and harder for clipping the timing gear stably. In the end, the work is painful and inefficient.

A timing gear holder may be provided to overcome the disadvantages above. However, the work, disassembling the timing gear, is still processed difficultly. The center of the timing gear is always hidden by the holder, intercepting disassembly of the timing gear and the nut beside the timing gear. Moreover, the holder fits single size timing gears. User can hardly service models of automobiles with single timing gear holder.

U.S. Pat. No. 2,121,085 discloses a clamp having a C-shaped body and a threaded bolt disposed through the C-shaped body. However, the C-shaped body cannot be adjusted to clamp a gear larger than the largest distance between two ends of the C-shaped body.

U.S. Pat. No. 6,978,703 discloses a cam gear holding and turning wrench, and a fixed jaw and a movable jaw are used to inset in openings of the cam gear. However, the fixed jaw and the movable jaw cannot be adjusted to clamp a cam gear larger than the largest distance between the fixed jaw and the movable jaw.

U.S. Pat. No. 3,857,307 discloses a shock absorber assembly tool for use with cartridge-type shock absorbers which are removably mounted within a cylindrical housing having a threaded retaining ring or the like mounted at one end thereof. The tool including a pair of longitudinally aligned spaced apart manually engageable handle sections, an intermediate section disposed between and connecting the handle sections, an adjustment member longitudinally slidably mounted on one of the handle sections, and a pair of connecting elements mounted on the tool and adapted for engagement with complementary-shaped elements on the retaining ring, whereby a rotational force exerted upon the tool will result in a corresponding rotation of the retaining ring for effecting relative rotation thereof with respect to the associated housing. However, the tool cannot be adjusted to clamp a greater gear.

The present invention is, therefore, arisen to obviate or at least mitigate the above mentioned disadvantages.

SUMMARY OF THE INVENTION

The main object of the present invention is to provide a gear grasping device which can grasp a timing gear without hiding the center of the gear.

Another main object of the present invention is to provide a gear grasping device which can be manipulated easily and can fit sizes of gears.

To achieve the above and other objects, a gear grasping device for grasping a gear of the present invention includes a main body, a first jaw, a second jaw, and an adjustment means.

The main body includes a handle and a curved portion. The curved portion is disposed on one end of the handle. The handle has a longitudinal direction. The curved portion is formed with an opening.

The first jaw is disposed on the main body. The first jaw has an extension direction parallel to an axial direction defined by the opening of the curved portion, and the first jaw being adjustable along the main body.

The second jaw is disposed on the main body. The curved portion is entirely located between the first jaw and the second jaw. A bottom surface of the first jaw faces toward a top surface of the second jaw, so that a jaw span is defined by the first jaw and the second jaw. Along the longitudinal direction, a greatest dimension of the curved portion is less than a diameter of the gear so that the jaw span is able to clamp outer teeth of the gear between the first jaw and the second jaw.

The adjustment means is utilized for adjusting position of the first jaw between a first position and a second position, so that a size of the jaw span is adjustable.

Therefore, by sliding of the first jaw, the gear grasping device fits sizes of gears with the adjustable jaw span. Besides, an axis defined by the opening is parallel to extension directions of the first jaw and the second jaw. The nut located beside the gear is approachable. Disassembly of the gear can be processed easily.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
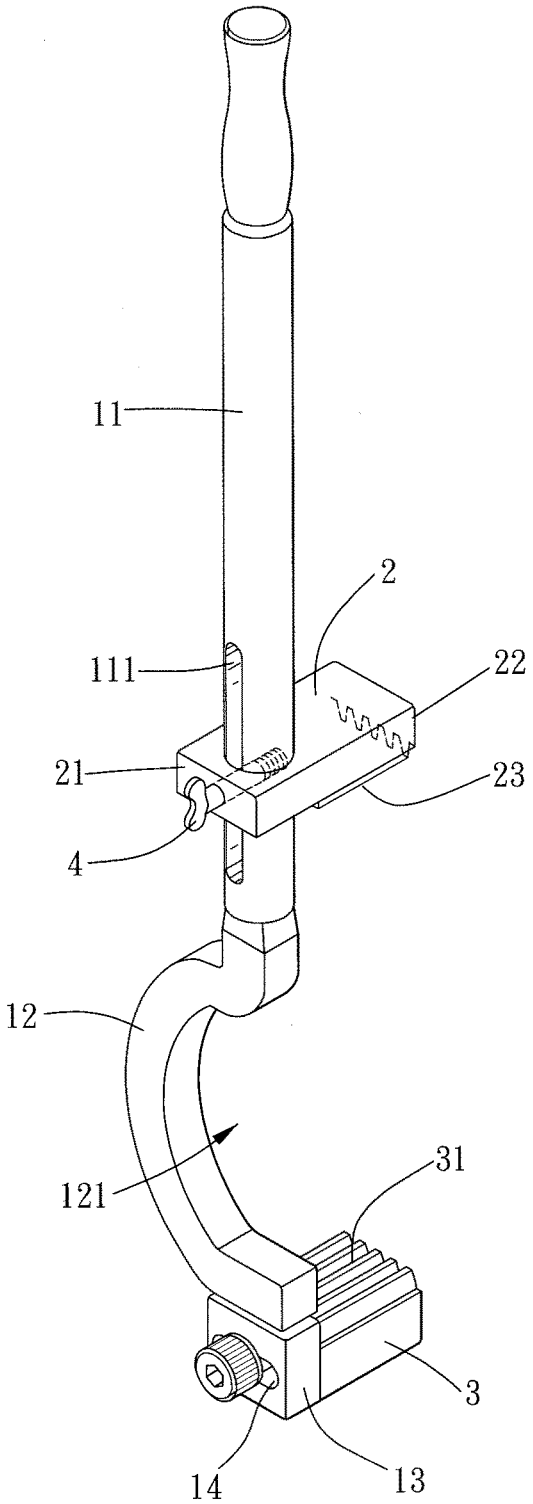
FIG. 1 is a stereogram showing a first embodiment of the present invention.

Please refer to FIG. 1 for a first embodiment of the present invention. The gear grasping device of the present embodiment includes a main body, a first jaw 2, a second jaw 3, and an adjustment means.

The main body includes a handle 11 and a curved portion 12. The handle 11 is formed with a sliding groove 111. The sliding groove 11 has a predetermined length extending along an axial direction of the handle 11. The sliding groove 111 has a bottom wall. The curved portion 12 is disposed on one end of the handle 11. The handle 11 has a longitudinal direction. The curved portion 12 is formed with an opening 121. Preferably, the curved portion 12 has a C-shaped appearance. In other possible embodiments of the present invention, the curved portion may have O-shaped, D-shaped, L-shaped, U-shaped, or polygonal appearance. In general, the curved portion has a bended or arched portion, and is formed with an opening at the center thereof.

The first jaw 2 is disposed on the main body and adjustable along the main body. Preferably, the first jaw 2 is disposed on the handle 11. The first jaw 2 has an extension direction parallel to an axial direction of the opening 121. In other words, the extension direction of the first jaw 2 is perpendicular to a forward direction of the opening 121 of the C-shaped curved portion. In the present embodiment, the first jaw 2 is a rectangular prism. In longitudinal direction, the first jaw 2 has two opposite ends, a first end 21 and a second end 22. The extension direction of the first jaw 2 is exactly the longitudinal direction of the first jaw 2. The first jaw 2 is formed with a hole. The hole penetrates through a top surface and a bottom surface of the first jaw 2. The hole is located adjacent to the first end 21. More particularly, an extension direction of the hole is parallel to a thickness direction of the first jaw 2. The handle 11 penetrates through the hole, so that the first jaw 2 is able to slide along the axial direction of the handle 11. The bottom surface of the first jaw 2 is formed with plural teeth 23, formed serrated. The teeth 23 have an extension direction parallel to the extension direction of the first jaw 2.

The second jaw 3 is disposed on the main body. The curved portion is located entirely between the first jaw 2 and the second jaw 3. More particularly, the second jaw 3 is disposed on one end of the curved portion 12 where is located away from the handle. The second jaw 3 is located at the same side as the first jaw 2 is with respect to the main body. An extension direction of the second jaw 3 is parallel to the extension of the first jaw 2. The bottom surface of the first jaw 2 faces toward a top surface of the second jaw 3. A jaw span is defined between the first jaw 2 and the second jaw 3. Just as the first jaw 2, the second jaw 3 is a rectangular prism, also. The top surface of the second jaw 3 is formed with plural teeth 31, formed serrated. The teeth 31 have an extension direction parallel to the extension of the second jaw 3. Along the longitudinal direction of the handle 11, a greatest dimension of the curved portion 12 is less than a diameter of the gear 7 so that the jaw span is able to clamp outer teeth of the gear 7 between the first jaw 2 and the second jaw 3. That is, the first jaw 2 and the second jaw 3 clamp on the outmost portion of the gear 7. An imaginary line is defined by a longitudinal direction of the handle 11. An enclosing space is defined and enclosed by the curved portion. At least one of the first jaw 2 and the second jaw 3 is located at the imaginary line, and the imaginary line penetrates through the enclosing space. Preferably, the imaginary line penetrates through all of the enclosing space, the first jaw 2, and the second jaw 3. Preferably, the first jaw 2 is adjustable along the longitudinal direction of the handle 11, and the second jaw 3 is adjustable along a direction which is perpendicular to the longitudinal direction and the axial direction defined by the opening 121 of the curved portion 12. Specifically, the main body further comprises a block 13. The block 13 is connected to an outer face of one end of the curved portion 12 away from the handle 11. The first jaw 2 is adjustable linearly along the longitudinal direction. The block 13 has a through slot 14 extending linearly in a direction perpendicular to the longitudinal direction and the axial direction defined by the opening 121 of the curved portion 12, and the second jaw 3 is adjustable along the through slot 14 to be partially beyond a free end of the curved portion 12 in the direction in which the through slot 14 extends. The first and second jaws 2, 3 are entirely located outside of the opening 121 of the curved portion 12.

The adjustment means is utilized for adjusting position of the first jaw 2 between a first position and a second position along the axial direction of the handle 11, so that a size of the jaw span is adjustable. In the present embodiment, the gear grasping device further includes a constrainer 4. The constrainer 4 pierces into the first jaw to abut against the bottom wall of the sliding groove 111 of the handle. The constrainer 4 is able to slide along the sliding groove 111. The first jaw 2 is then motivated to slide between the first position and the second position, so that size of the jaw span is adjustable. By twisting the constrainer 4, the constrainer 4 is able to stably stay in position, keeping the first jaw 2 at a desired position between the first position and the second position.

Figure 5:
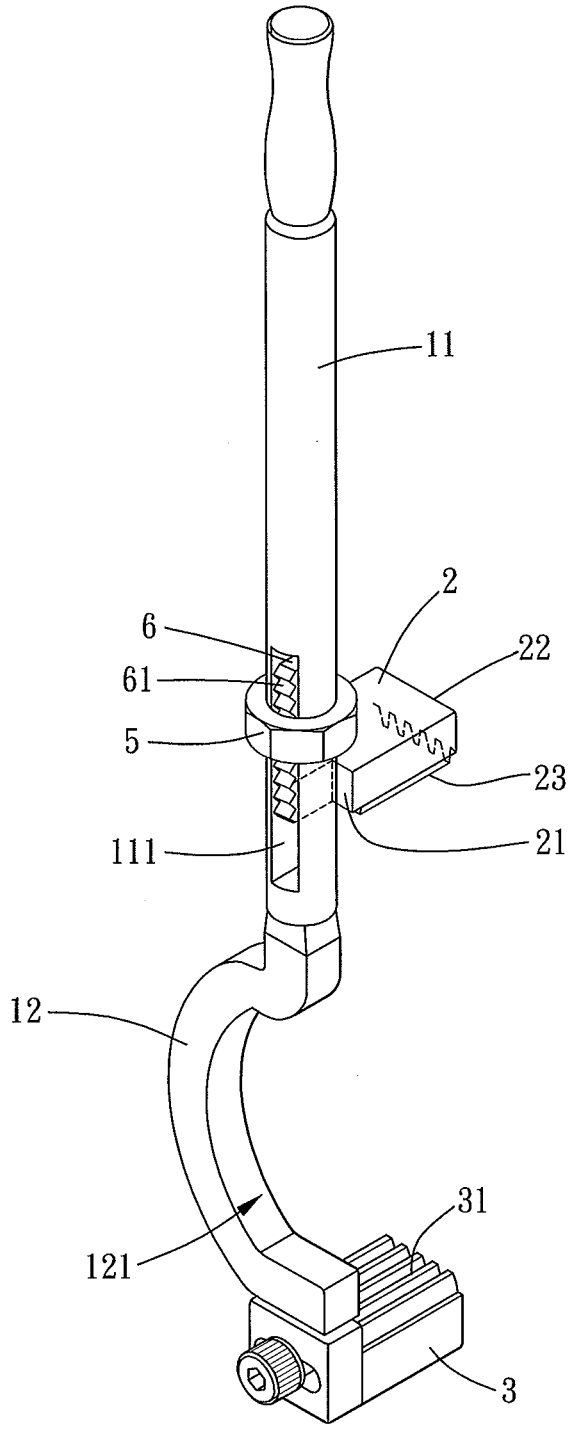
FIG. 5 is a stereogram showing a second embodiment of the present invention.

Please refer to FIG. 5. In a second embodiment of the present invention, the gear grasping device is provided with another adjustment means alternatively. The first jaw 2 is formed with no hole. The gear grasping device further includes a nut 5 and a rack 6. The nut 5 is formed with a thread therein. The rack 6 is mounted to the first end 21 of the first jaw 2. The rack 6 is slidably received in the sliding groove 111. The rack 6 is formed with plural teeth 61. The teeth 61 are spaced arranged axially. The thread of the nut 5 selectively engages some of the teeth 61, so that the rack 6 is able to slide along the sliding groove 111 when the nut 5 rotates. Thus, the first jaw 2 is motivated to slide between the first position and the second position, and stopped and kept at a random position between the first position and the second position by friction. In the present embodiment, the teeth 61 is disposed at a side of the rack where is located away from the first jaw. The teeth 61 are laterally extended for better engagement with the thread of the nut. Preferably, the other side of the rack where is located adjacent to the first jaw is formed with teeth, also. Thus, the nut engages both two sides of the rack. Motion of the rack 6 along the sliding groove 111 is then smoothened.

Figure 2:
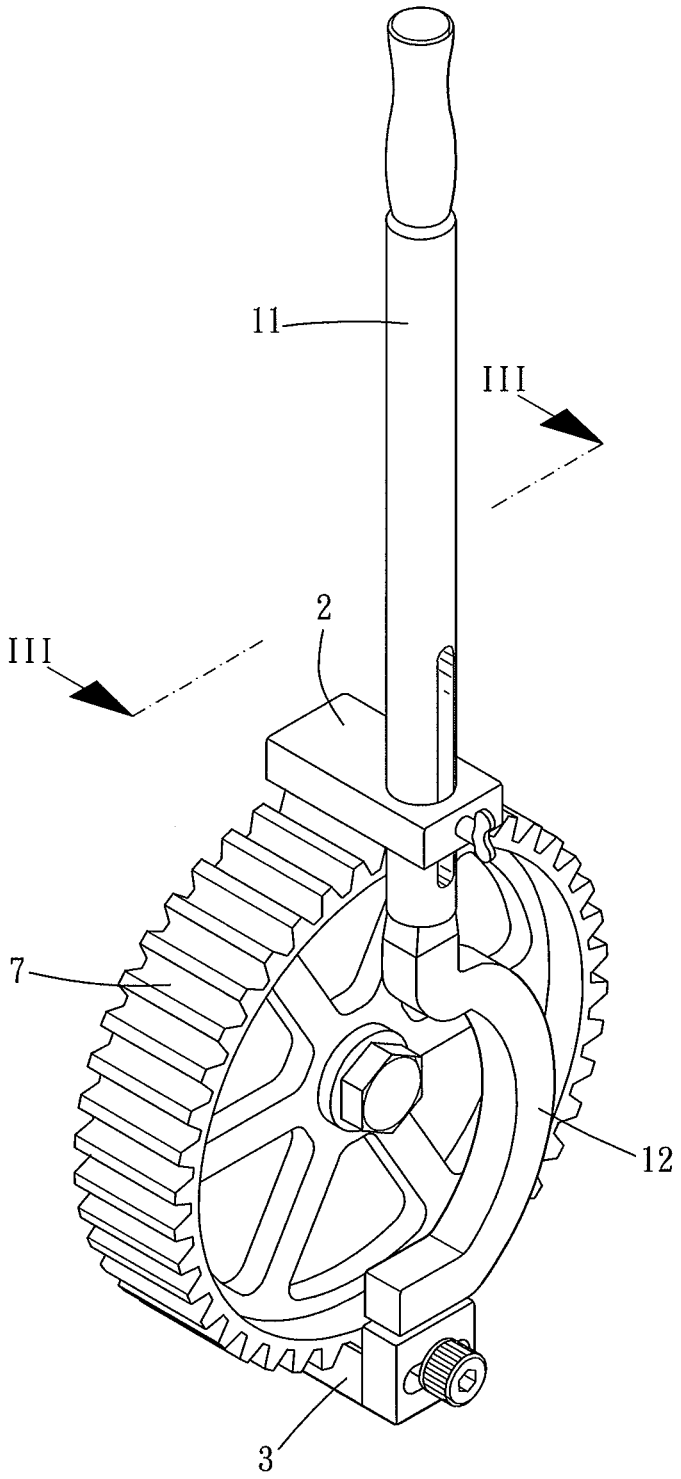
FIG. 2 is a schematic drawing showing a grasping condition of a first embodiment of the present invention.
Figure 3:
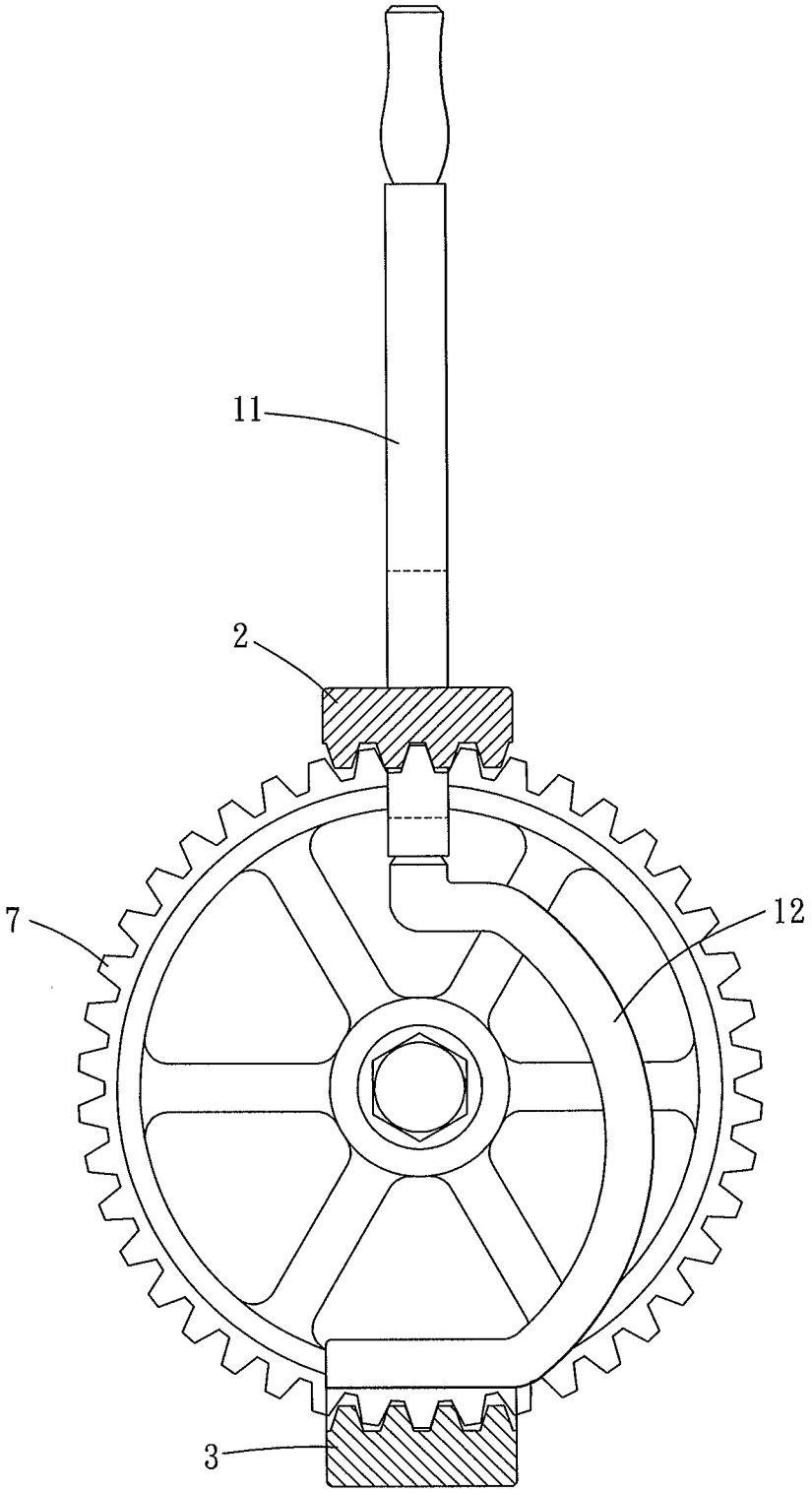
FIG. 3 is an profile of FIG. 2.

Please refer to FIG. 2 and FIG. 3. The gear grasping device is provided for grasping a gear 7. In manipulation, the adjustment means is firstly utilized for driving the first jaw 2 to slide toward the first position along the axial direction of the handle 11. In other words, the first jaw 2 is motivated to slide away from the second jaw 3. The jaw span is enlarged. The gear 7 is then positioned in the jaw span, engaging with the teeth of the second jaw 3. In the end, by the adjustment means, the first jaw 2 is driven to slide toward the second position along the axial direction of the handle 11. In other words, the first jaw 2 is moved toward the second jaw 3. The teeth formed on the bottom surface of the first jaw 2 engage the gear 7, as shown in FIG. 2 and FIG. 3. Therefore, the gear 7 is stably held by the gear grasping device.

Figure 4:
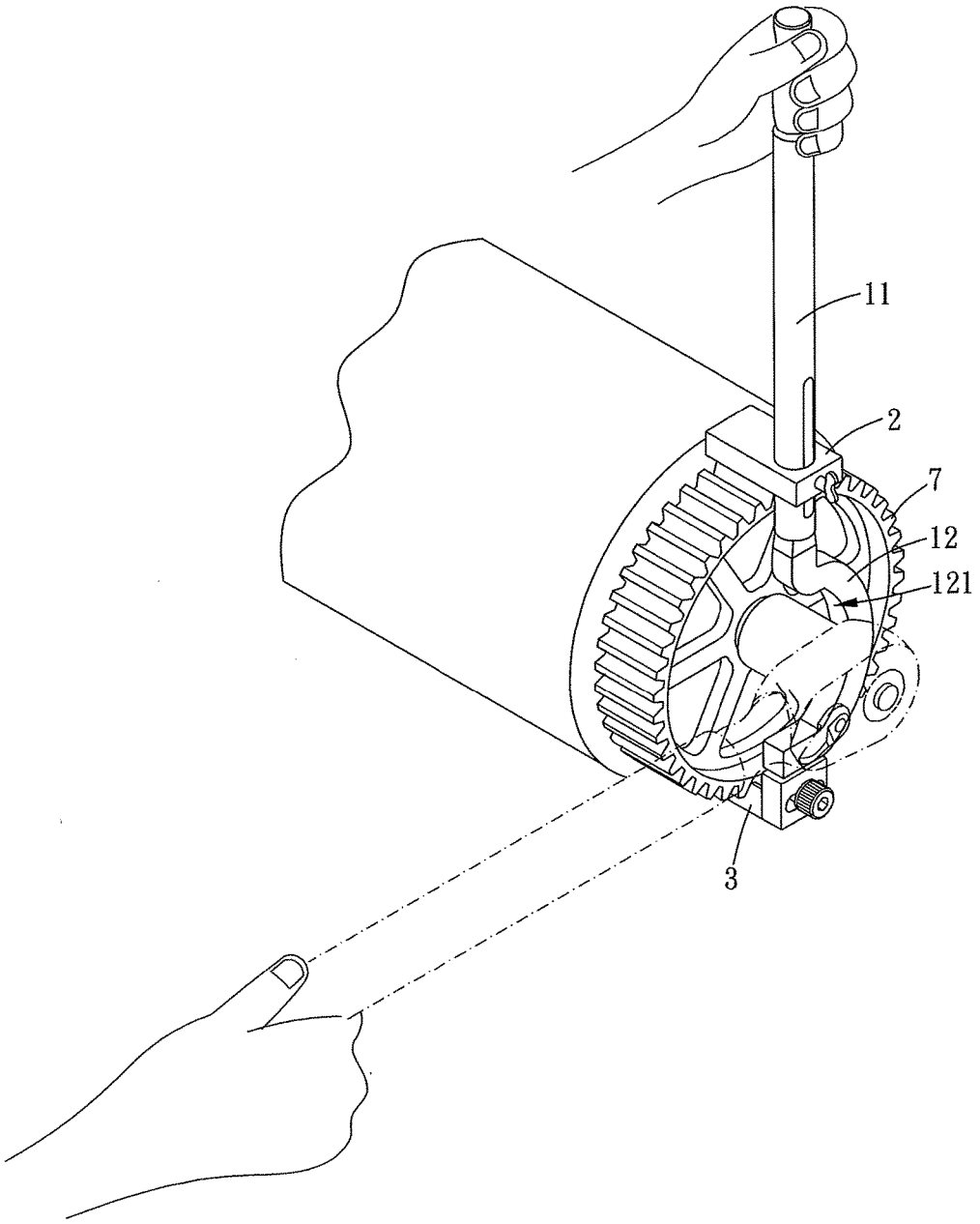
FIG. 4 is a schematic drawing showing an operation condition of a first embodiment of the present invention.

Please refer to FIG. 4, which illustrates disassembly of a camshaft of an engine of an automobile. The gear 7 is initially disposed on one end of the camshaft. The gear grasping device is utilized for grasping and holding the gear 7. Another detachment tool is utilized for removing the threaded member which is centrally fixed on the gear 7 and the camshaft. When removing the threaded member, one end of the detachment tool can be moved passing through the opening 121 of the curved portion without obstruction. The threaded member is then removed easily by twisting and rotating. Therefore, detachment and disassembly of the gear 7 and the camshaft can be processed smoothly.

Accordingly, the first jaw is able to slide with respect to the handle, adjusting the size of the jaw span. The gear grasping device is fit for sizes of gears. The gear grasping device is able to clamp a gear larger than the curved portion and is able to bypass the axe of the gear.

Besides, the first jaw is kept stably in position after the first jaw and the second jaw engage the gear. User can hold the gear grasping device gently, and unexpected rotation of the gear is then prohibited. Work efficiency is improved.

Moreover, the axial direction of the opening of the curved portion is parallel to the extension directions of the first jaw and the second jaw. That is to say, the axial direction of the opening of the curved portion would parallel to the axial direction of the gear when the gear is grasped. Therefore, the opening of the curved portion would face radially away from the gear. Detachment tool fitting with the threaded member would not be obstructed. Detachment and disassembly is therefore processed smoothly.

What is claimed is:

1. A gear grasping device for grasping a gear, comprising:

a main body, comprising a handle, a curved portion and a block, the handle having a longitudinal direction, the curved portion being disposed on one end of the handle, the curved portion being formed with an opening, the block being connected to an outer face of one end of the curved portion away from the handle;

a first jaw, disposed on the handle, the first jaw having an extension direction parallel to an axial direction defined by the opening of the curved portion, the first jaw being adjustable linearly along the longitudinal direction;

a second jaw, disposed on the main body, the curved portion being entirely located between the first jaw and the second jaw;

wherein a bottom surface of the first jaw faces toward a top surface of the second jaw, so that a jaw span is defined by the first jaw and the second jaw, along the longitudinal direction a greatest dimension of the curved portion is less than a minimum jaw span; and an adjustment means for adjusting position of the first jaw between a first position and a second position, so that a size of the jaw span is adjustable;

wherein the block has a through slot extending linearly in a direction perpendicular to the longitudinal direction and the axial direction defined by the opening of the curved portion, the second jaw is adjustable along the through slot to be partially beyond a free end of the curved portion in the direction in which the through slot extends; and wherein the first and second jaws are entirely located outside of the opening of the curved portion.

2. The gear grasping device of claim 1, wherein the handle is formed with a sliding groove, the sliding groove has a predetermined length extending along the axial direction of the handle.

3. The gear grasping device of claim 2, wherein the first jaw is formed with a hole which penetrates through the bottom surface and a top surface of the first jaw, the handle penetrates through the hole, so that the first jaw is able to slide along the axial direction of the handle; and wherein the gear grasping device further comprises a constrainer, the sliding groove has a bottom wall, the constrainer pierces into the first jaw to abut against the bottom wall of the sliding groove of the handle, the constrainer is able to slide along the sliding groove, leading slide of the first jaw between the first position and the second position, the constrainer is able to stably stay in position, keeping the first jaw at a desired position between the first position and the second position.

4. The gear grasping device of claim 3, wherein the bottom surface of the first jaw is formed serrated.

5. The gear grasping device of claim 4, wherein the top surface of the second jaw is formed serrated.

6. The gear grasping device of claim 3, wherein the top surface of the second jaw is formed serrated.

7. The gear grasping device of claim 3, wherein the curved portion has a C-shaped appearance.

8. The gear grasping device of claim 2, wherein the gear grasping device further comprises a nut and a rack, the nut is rotatably disposed around the handle and the rack, the nut is formed with a thread therein, the first jaw has a first end and a second end, the rack is mounted to the first end of the first jaw, the rack is slidably received in the sliding groove; and wherein the rack is formed with plural teeth, the teeth are axially arranged, the nut selectively engages some of the teeth and the first jaw moves away from or close to the nut when the nut rotates, so that the rack is able to slide along the sliding groove, leading slide of the first jaw between the first position and the second position, and the first jaw is kept at a random position between the first position and the second position.

9. The gear grasping device of claim 8, wherein the bottom surface of the first jaw is formed serrated.

10. The gear grasping device of claim 9, wherein the top surface of the second jaw is formed serrated.

11. The gear grasping device of claim 8, wherein the top surface of the second jaw is formed serrated.

12. The gear grasping device of claim 8, wherein the curved portion has a C-shaped appearance.

13. The gear grasping device of claim 1, wherein the bottom surface of the first jaw is formed serrated.

14. The gear grasping device of claim 1, wherein the top surface of the second jaw is formed serrated.

15. The gear grasping device of claim 1, wherein the curved portion has a C-shaped appearance.

* * * * *